US006990964B2

(12) United States Patent
Ströhle

(10) Patent No.: US 6,990,964 B2
(45) Date of Patent: Jan. 31, 2006

(54) APPARATUS FOR REGULATING THE GAS/AIR RATION FOR A PRE-MIXING COMBUSTION DEVICE

(75) Inventor: Werner Ströhle, Klaus (AT)

(73) Assignee: Hovalwerk AG, (LI)

( * ) Notice: Subject to any disclaimer, the term of this patent is extended or adjusted under 35 U.S.C. 154(b) by 0 days.

(21) Appl. No.: 10/851,453

(22) Filed: May 20, 2004

(65) Prior Publication Data

US 2004/0237947 A1 Dec. 2, 2004

(30) Foreign Application Priority Data

May 30, 2003 (DE) ..... 103 24 706

(51) Int. Cl.
*F02M 21/04* (2006.01)

(52) U.S. Cl. ..... 123/527

(58) Field of Classification Search ..... 123/527, 123/525

See application file for complete search history.

(56) References Cited

U.S. PATENT DOCUMENTS 4,465,052 A * 8/1984 Dolderer ..... 123/527
5,527,367 A * 6/1996 Harada ..... 48/189.3
6,016,832 A * 1/2000 Vars et al. ..... 137/487.5
6,050,246 A * 4/2000 Abdelmesih ..... 123/527
6,267,105 B1 * 7/2001 Bertossi ..... 123/525
6,626,158 B2 * 9/2003 Algeri ..... 123/527

* cited by examiner

*Primary Examiner*—Henry C. Yuen
*Assistant Examiner*—Jason Benton
(74) *Attorney, Agent, or Firm*—Blakely Sokoloff Taylor & Zafman

(57) ABSTRACT

The apparatus has a pneumatic controller, which controls the pressure in a gas conduit (1) in dependence on the pressure in an air conduit (2). Provided downstream of the regulator is a mixing device (4), which has a venturi-like mixing chamber (7). Extending into the inlet opening of the mixing chamber (7) is a nozzle (8), which is connected to the air conduit (2). Defined between the nozzle (8) and the edge (9) of the inlet opening of the mixing chamber (7) is an annular gap (10), which is connected to the gas conduit (1). Also operating in the air conduit (2) is a conical member (11) which is actuated by a linear motor (12). The mixture is withdrawn from the mixing chamber (7) by a fan (5), whose speed is controllable, and fed to the combustion device. The adjusting motor (12) for the conical member (11) operates in dependence on a signal from a sensor, which detects changes in the gas quality, the air pressure and/or the combustion air temperature. The cross-section of the nozzle (8) connected to the air conduit (2) is blocked to a greater or lesser extent in dependence thereon in order to superimpose the sensor regulation on the pneumatic regulation.

4 Claims, 1 Drawing Sheet

APPARATUS FOR REGULATING THE GAS/AIR RATION FOR A PRE-MIXING COMBUSTION DEVICE

BACKGROUND OF THE INVENTION

The invention relates to an apparatus for regulating the gas/air ratio for a pre-mixing combustion device.

In order to minimise the emission of pollutants and to optimise the efficiency of combustion devices, efforts are made to maintain the gas/air ratio at an optimal point.

Systems with a pneumatic coupling and systems with an electronic coupling are known.

In the case of systems with a pneumatic coupling, the volumetric flow of the gas is maintained in a constant ratio to the volumetric flow of the air. This is effected by means of a pressure-controlled regulator in the gas pathway. A pressure difference is used as the control pressure to regulate the gas volumetric flow in direct dependence on the induced volumetric flow of the air. The control pressure for the regulator is produced in a mixing device or at an orifice in the air pathway.

The systems with a pneumatic coupling require no electrical or electronic components. Their mechanical construction is very simple and operates very rapidly. They need only a few moveable components. The mixture preparation with a pneumatic coupling has the advantage of reacting very rapidly to variations in pressure and volumetric flow in the combustion installation and maintaining the gas/air ratio constant within a large modulation range. These robust systems have thus proved themselves to be satisfactory in many installations.

Influence parameters, such as gas quality, air pressure and combustion air temperature, can, however, not be compensated for by these systems by control techniques and necessitate an adjustment to the installations. As a result of the liberalisation of the gas market, relatively large variations in gas quality are to be expected, which make constant adjustment necessary with these systems.

Furthermore, systems with a pneumatic coupling become imprecise with a large modulation range in the lower power range, particularly after a relatively long period of operation. In order to ensure the combustion quality over the long term, the minimum power which is set may thus not be, depending on the construction, less than a value of 15–20%.

In systems with an electronic coupling, the composition of the combustion gases in the flame or after the flame or the flame temperature are measured by a sensor. The sensor produces a signal, which is analysed by an electronic regulator. The latter controls a regulating member, which determines the volume of gas. These systems with an electronic coupling are slower to stabilise control as regards changes in the air volume as regards the control. The sensors which are used are sensitive and have a limited surface life. A satisfactory sensor signal is necessary for the reliable functioning of the combustion installation. Variations in the gas quality, the air pressure and the combustion air temperature can, however, be compensated for by the controller.

BRIEF SUMMARY OF THE INVENTION

The object of the invention is to produce the advantages of the systems with an electronic coupling in a system with a pneumatic coupling without giving up the advantages achieved thereby.

In order to solve this object, the invention provides an apparatus for regulating the gas/air ratio for a pre-mixing combustion device including a pneumatic regulator.

Apparatus for regulating the gas/air ratio for a pre-mixing combustion device including a pneumatic regulator, which maintains the ratio of the pressure in a gas conduit and the pressure in an air conduit constant, a mixing device, which is arranged downstream of the regulator and has the following features:

- a mixing chamber, which diverges from its inlet opening in the flow direction in the manner of a venturi nozzle,
- a nozzle, which is connected to the air conduit and extends into the inlet opening of the mixing chamber,
- an annular gap, which is connected to the gas conduit and is defined between the edge of the inlet opening of the mixing chamber and the nozzle connected to the air conduit, and
- a conical member, which is arranged in the air conduit and is moveable in the axial direction relative to the nozzle connected to the air conduit in dependence on a signal from a sensor, and including a fan whose speed may be controlled and conveys the mixture out of the mixing chamber to the combustion device.

The regulator constitutes the pneumatic coupling of the system and the sensor supplies the signal which enables the effects of the variation in the gas quality, the air pressure and the combustion air temperature to be compensated for. The conical member, which is preferably actuable by a linear motor, moves in dependence on this signal and travels to a greater or lesser depth into the nozzle connected to the air conduit. It can thus be ensured in an extremely simple manner that the combustion device always operates with an optimal gas/air ratio.

The sensor can detect the composition and/or the temperature of the combustion exhaust gases and the electronic system can determine therefrom the current values of the gas quality, the air pressure and the combustion air temperature so that appropriate regulation is rendered possible by moving the conical member. As a result of the pressure and flow conditions, which are changed in this manner, in the mixing chamber, which diverges in the manner of a venturi nozzle, it is possible to alter the gas/air ratio within a broad range without losing the advantages of the pneumatic coupling.

As a result of the introduction of the conical member into the nozzle connected to the air conduit, the speed of the air entering the mixing chamber increases. A more substantially reduced pressure is thus produced in the annular gap connected to the gas conduit which permits the volume of gas entering into the mixing chamber to increase. At the same time, the amount of air flowing in is reduced as a result of the constriction of the cross-sectional area of the nozzle connected to the air conduit. The result is that more gas is conveyed into the mixing chamber with less air.

Furthermore, the degree of modulation is increased in accordance with the invention so that discrepancies can be compensated for by the control, even at low power.

If the combustion device is shut down, the conical member can completely close the nozzle connected to the air conduit. Thus if the combustion device is connected to an exhaust device installation, which is available to further combustion devices operating with pressurised exhaust gas, the exhaust gas is prevented in this manner from flowing back into the air conduit of the combustion device which has been shut down.

In the event of failure of the sensor, the conical member is moved completely out of the nozzle connected to the air conduit. The minimum power of the combustion device is increased so far that the combustion is maintained in an operating region which does not necessarily require the intervention of the sensor. The minimum power is increased, for instance, to ca. 20%. The basic setting of the pneumatic regulator thus ensures that a sufficiently high excess of air is maintained with the types of gas, air temperatures and height positions that are to be expected. In this position of the conical member, the regulation corresponds to a conventional pneumatic coupling. The combustion installation does not need to be shut down and the emission of pollutants remains below the prescribed threshold values. Previously known systems with an electronic coupling must be shut down in the event of failure of the sensor.

In summary, the following advantages may thus be obtained with the invention:

Variations in the gas quality, the air pressure and the combustion air temperature can be controlled without losing the advantages of the pneumatic coupling, namely the ability to react rapidly to changes in power and variations in pressure.

The combustion device functions even if the sensor should fail, since the pneumatic coupling, on which the regulation is constructed, continues to remain functional.

A regulator with a pneumatic coupling, which has a mixing chamber diverging in the manner of a venturi nozzle can also be retro-fitted with a sensor-controlled conical member.

The efficiency increases since the combustion is controlled to be closest to the stoichiometric value. More condensate is thus produced at a higher dew point and less combustion air need be heated unnecessarily. With pneumatic regulators without sensor control, a higher excess of air must be maintained in order to maintain sufficient distance from the stoichiometric value in the event of variations in gas quality, air pressure and combustion air temperature. Only in this way can the production of poisonous carbon monoxide be reliably prevented with these systems.

The degree of modulation is increased due to the fact that a smaller minimum power can be set. With a purely pneumatic coupling, adequate stability of the gas/air ratio is not ensured at such small powers.

The start/stopp emissions are minimised by the fact that fewer controls are necessary due to the smaller minimum power.

The combustion device can be connected with other combustion installations to a common exhaust gas installation operating with an overpressure without their being a risk of exhaust gas flowing back into its installation space in the event of shut down of the combustion device since the conical member can completely close the air conduit.

The opening angle of the nozzle connected to the air conduit advantageously substantially corresponds to the angle of the conical member. This contributes to the nozzle connected to the air conduit being completely closeable by the conical member, as is provided in an embodiment of the invention.

It has proved to be particularly advantageous to provide the conical member with an angle of less than 30°. This angle enables very sensitive adjustment of the conical member and thus very sensitive regulation. However, conical members with an angle of more than 30° are also possible under certain circumstances.

BRIEF DESCRIPTION OF THE DRAWINGS

The invention will be explained below in more detail by way of a preferred exemplary embodiment in conjunction with the accompanying drawings, in which.

DETAILED DESCRIPTION OF THE INVENTION

Figure 1:
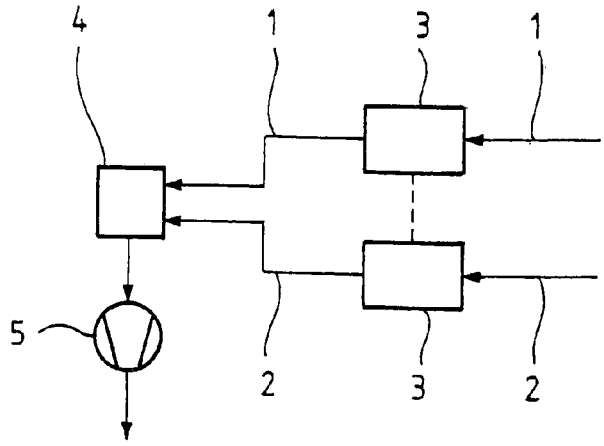
FIG. 1 is a circuit diagram of the apparatus in accordance with the invention.

The apparatus shown in FIG. 1 has a gas conduit 1 and an air conduit 2. Operating between the two conduits is a pneumatic regulator 3, which controls the pressure in the gas conduit 1 in dependence on the pressure in the air conduit 2. The gas conduit 1 and the air conduit 2 both communicate with a mixing device 4. Arranged downstream of the mixing device 4 is a fan 5, whose speed may be controlled and which conveys the mixture to a combustion device, which is not shown.

Figure 2:
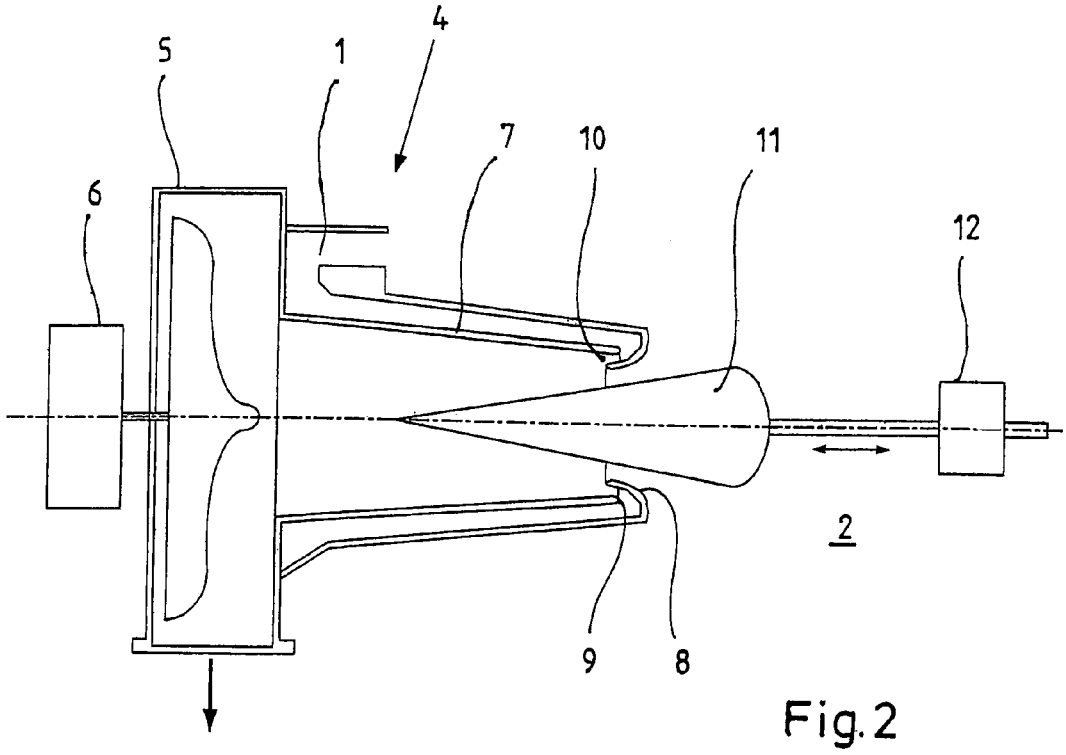
FIG. 2 is an axial sectional view of a component schematically illustrated in FIG. 1.

FIG. 2 shows in detail the construction of the mixing device 4, to which the fan 5 is directly connected. The latter is driven by a motor 6, whose speed may be controlled.

The mixing device 4 has a mixing chamber 7, which diverges from its inlet opening in the flow direction in the manner of a venturi nozzle. Extending into the inlet opening of the mixing chamber 7 is a nozzle 8, which is connected to the air conduit 2. The nozzle 8 defines, together with the edge 9 of the inlet opening of the mixing chamber 7, an annular gap 10, which is connected to the gas conduit 1.

Arranged in the air conduit 2 is a conical member 11, which is moveable in the axial direction relative to the nozzle 8 by a linear motor 12. The conical member 11 is controlled by a sensor, which is not shown and which, in the present case, detects the composition of the combustion exhaust gases. It supplies a signal which is representative of the current gas quality.

In the position shown in FIG. 2, the conical member 11, whose angle, in this exemplary embodiment, is less than 30° and is the same as the opening angle of the nozzle 8, extends into the latter. If the gas quality changes in the direction of a lower calorific value, the linear motor 12 moves the conical member 11 to the left further into the nozzle 8. The speed, with which the air enters the mixing chamber 7, is thus increased. Consequently, more gas is conveyed into the mixing chamber 7. At the same time, the amount of air entering the mixing chamber 7 decreases. The result is that less air conveys more gas into the mixing chamber 7. This compensates for the reduced calorific value.

In the event of an increase in calorific value, the regulator operates in the opposite direction. As a result of movement of the conical member 11, variations in the air pressure and the combustion air temperature can be compensated for.

The invention combines the advantage of a pneumatic coupling with the advantages of an electronic coupling with a simultaneous increase in the degree of modulation. The minimum power of the combustion device can be reduced without a loss of stability.

If the combustion device is shut down, the conical member 11 can be moved so far into the nozzle that it closes it. This prevents back flow of exhaust gas into the air conduit 2, if the combustion device is connected to an exhaust gas system, to which an overpressure is applied by further combustion devices.

If the sensor controlling the linear motor 12 of the conical member 11 fails, the conical member 11 is moved so far to the right that it completely opens the cross-sectional area of the nozzle 8. The combustion device is then controlled individually and only by means of the pneumatic regulator 3, that is to say in the conventional manner of a pneumatic coupling. It is recommended that the minimal power of the coupling device be increased.

Modifications are of course possible within the scope of the invention. Thus the pneumatic regulator 3 can detect the control pressure for controlling the pressure in the gas conduit 1 at a position other than in the air conduit 2, for instance in the mixing chamber 7. The sensor controlling the linear motor 12 can also detect, for instance, only the combustion air temperature and/or the air pressure or the gas quality.

I claim:

1. An apparatus for regulating the gas/air ratio for a pre-mixing combustion device comprising:

a pneumatic regulator, which maintains a ratio of pressure in a gas conduit and pressure in an air conduit constant;

a mixing device, which is arranged downstream of the regulator, said mixing device comprising:

a mixing chamber, which diverges from its inlet opening in the flow direction in the manner of a venturi nozzle, a nozzle, which is connected to the air conduit and extends into the inlet opening of the mixing chamber, an annular gap, which is connected to the gas conduit and is defined between an edge of the inlet opening of the mixing chamber and the nozzle connected to the air conduit, and a conical member, which is arranged in the air conduit and is moveable in an axial direction relative to the nozzle connected to the air conduit in dependence on a signal from a sensor; and a fan whose speed is controllable, said fan for conveying a gas/air mixture out of the mixing chamber to the combustion device.

2. The apparatus of claim 1, wherein the conical member is moveable by a linear motor.

3. The apparatus of claim 1, wherein an opening cross-sectional area of the nozzle connected to the air conduit is substantially equal to a cross-sectional area of the conical member.

4. The apparatus of claim 1, wherein the angle of the conical member is less than 30°.

* * * * *